US008163367B2

(12) United States Patent
Lee

(10) Patent No.: US 8,163,367 B2
(45) Date of Patent: Apr. 24, 2012

(54) WATER ABSORBING MAT

(76) Inventor: Szu-Hsien Lee, Kaohsiung (TW)

( * ) Notice: Subject to any disclaimer, the term of this patent is extended or adjusted under 35 U.S.C. 154(b) by 240 days.

(21) Appl. No.: 12/557,694

(22) Filed: Sep. 11, 2009

(65) Prior Publication Data

US 2011/0064904 A1 Mar. 17, 2011

(51) Int. Cl.
*B32B 3/20* (2006.01)

(52) U.S. Cl. ..... 428/71; 428/68; 4/251.1

(58) Field of Classification Search ..... 428/68, 428/71; 15/215, 217; 4/251.1; 296/97.23; 52/177
See application file for complete search history.

(56) References Cited

U.S. PATENT DOCUMENTS 3,578,738 A * 5/1971 Hughes ..... 15/215

* cited by examiner

*Primary Examiner* — Alexander Thomas

(57) ABSTRACT

A water absorbing mat includes a base having an internal space open to a top; a squeezing unit disposed in the internal space and comprising a plurality of water bladders having a plurality of legs; and a water absorbing unit disposed on the water bladders and formed of a predetermined water absorbing material such as pile threads or foam.

11 Claims, 7 Drawing Sheets

WATER ABSORBING MAT

BACKGROUND OF THE INVENTION

1. Field of Invention

The invention relates to water absorbing devices and more particularly to a water absorbing mat with improved characteristics.

2. Description of Related Art

Conventional water absorbing mats suffer from several disadvantages. For example, their water storage capacity is very limited. Hence, it is often that surrounding area of the water absorbing mat is wet because water overflows from the saturated water absorbing mat. This is not only visually unattractive but also a person may slip if sufficient care is not taken. Thus, the need for improvement still exists.

SUMMARY OF THE INVENTION

It is therefore one object of the invention to provide a water absorbing mat comprising a base having an internal space open to a top; a squeezing unit disposed in the internal space and comprising a plurality of water bladders having a plurality of legs; and a water absorbing unit disposed on the water bladders and formed of a predetermined water absorbing material.

The above and other objects, features and advantages of the invention will become apparent from the following detailed description taken with the accompanying drawings.

DETAILED DESCRIPTION OF THE INVENTION

Figure 1:
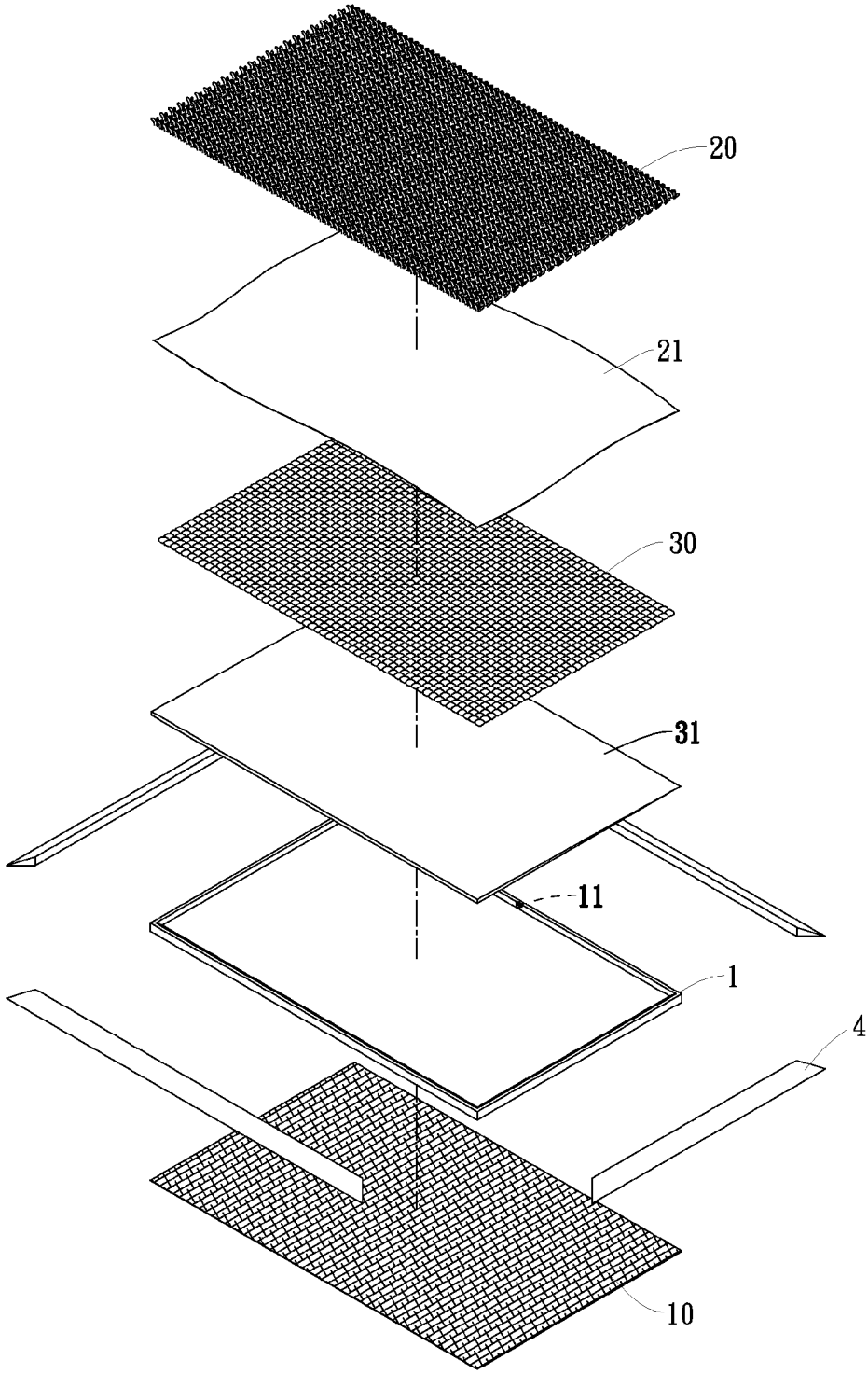
FIG. 1 is an exploded view of a first preferred embodiment of water absorbing mat according to the invention.
Figure 2:
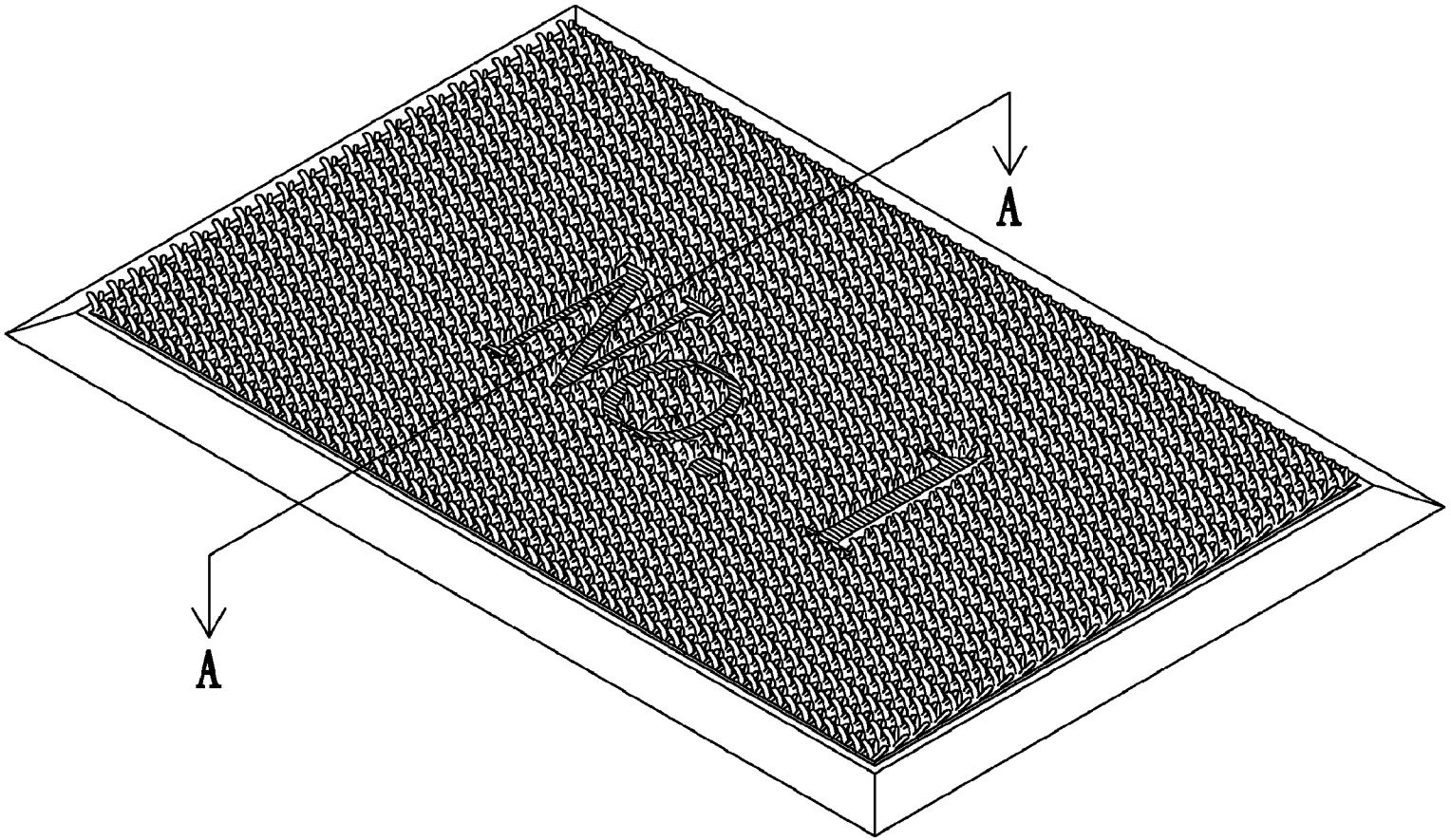
FIG. 2 is a perspective view of the assembled water absorbing mat of FIG. 1.
Figure 3:
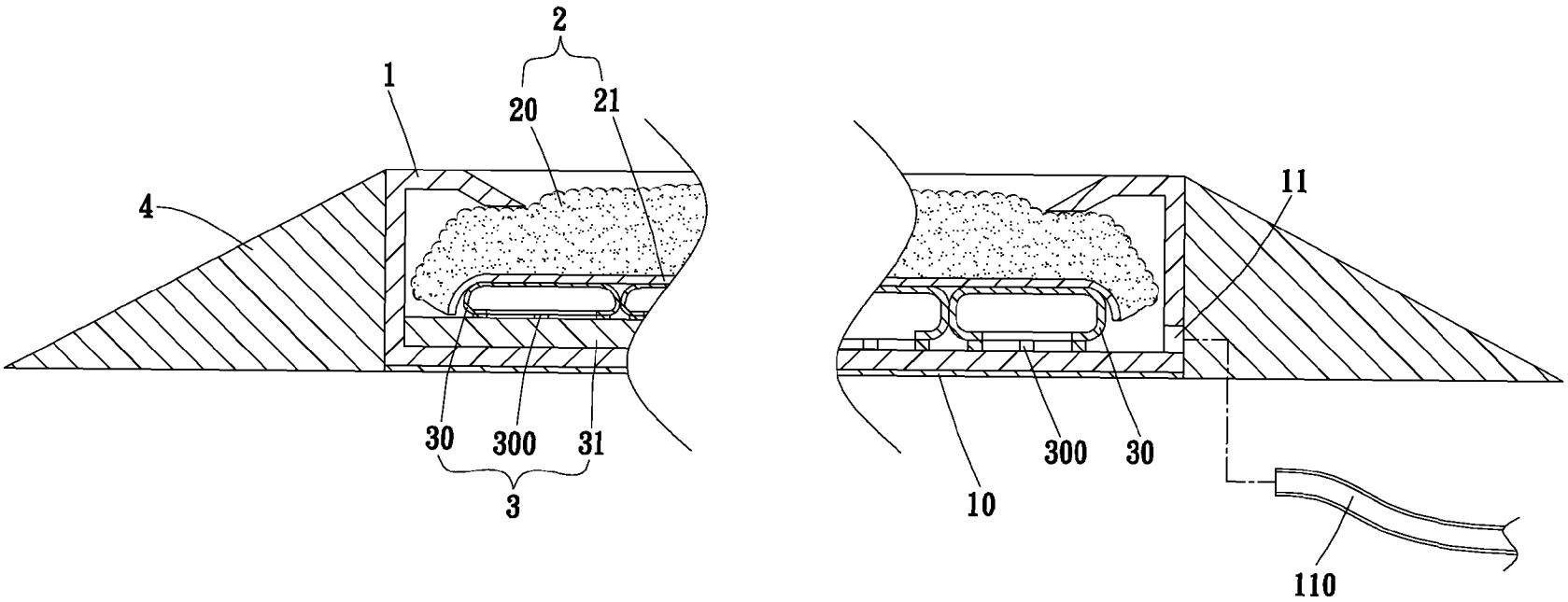
FIG. 3 is a sectional view taken along line A-A of FIG. 2.

Referring to FIGS. 1 to 3 and 7, a water absorbing mat in accordance with a first preferred embodiment of the invention comprises the following components as discussed in detail below.

A rectangular base 1 comprises a slip resistant layer 10 on the underside and a valve 11 on the bottom of one side. The slip resistant layer 10 can be either adhesively secured to the underside of the base 1 or integrally formed therewith. The slip resistant layer 10 is implemented with an uneven bottom or the like for increasing its traction on the ground. The valve 11 is closed in use.

The base 1 has an open top, an inward inclined top edge, and four vertical sides. Four edge members 4 having an inclined outer surface are adhesively secured to the sides of the base 1. Alternatively, the edge members 4 are integrally formed with the sides of the base 1 in the manufacturing process. The provision of the edge members 4 can prevent the sides of the base 1 from being damaged by the foot in walking due to carelessness.

A squeezing unit 3 is provided on a lower portion of an internal space defined by the base 1. Within the squeezing unit 3 there are provided a spacer layer 31 rested upon the bottom of the base 1, and a plurality of engaged water bladders 30 having a plurality of (e.g., four) legs 300 on the underside for providing a spacing between the water bladder 30 and the spacer layer 31 or the bottom of the base 1 (see FIG. 3).

A water absorbing unit 2 is provided in the base 1 and is disposed on the squeezing unit 3. The water absorbing unit 2 comprises a water permeable fabric 21 rested upon the water bladders 30, and a water absorbing material 20 formed of pile threads provided on the water permeable fabric 21. The water absorbing material 20 has an uneven top surface so that a person may exert a force upon the water absorbing material 20 by the foot to remove dirt from his or her foot or shoe. Moreover, a logo or word is printed on the water absorbing material 20 for commercial purposes.

Water collected by the water absorbing material 20 can be stored temporarily therein. A person may use his or her foot to step on the water absorbing material 20 to squeeze water out of the water absorbing material 20. As a result, water flows from the water absorbing material 20 to the water bladders 30 through the water permeable fabric 21 for storage.

A person may understand that both the water absorbing unit 2 and the squeezing unit 3 are full of water if he or she can clearly see water on the top of the water absorbing material 20. Then, the person may remove one edge member 4. Next, the person may attach one end of a pipe 110 (which has the other end disposed in or proximate a drain) to the valve 11 and open the valve 11 so that water may flow from the water bladders 30 to the outside via the valve 11 and the pipe 110 for discharge if the water absorbing mat is used indoors. Alternatively, the person may open valve 11 to discharge water directly if the water absorbing mat is used outdoors.

Preferably, the spacer layer 31 is inclined toward the valve 11 for facilitating the discharge.

Preferably, the water bladders 30 are not shaped the same. That is, the water bladders 30 are shaped differently to conform to the spacer layer 31 disposed therebelow.

Figure 4:
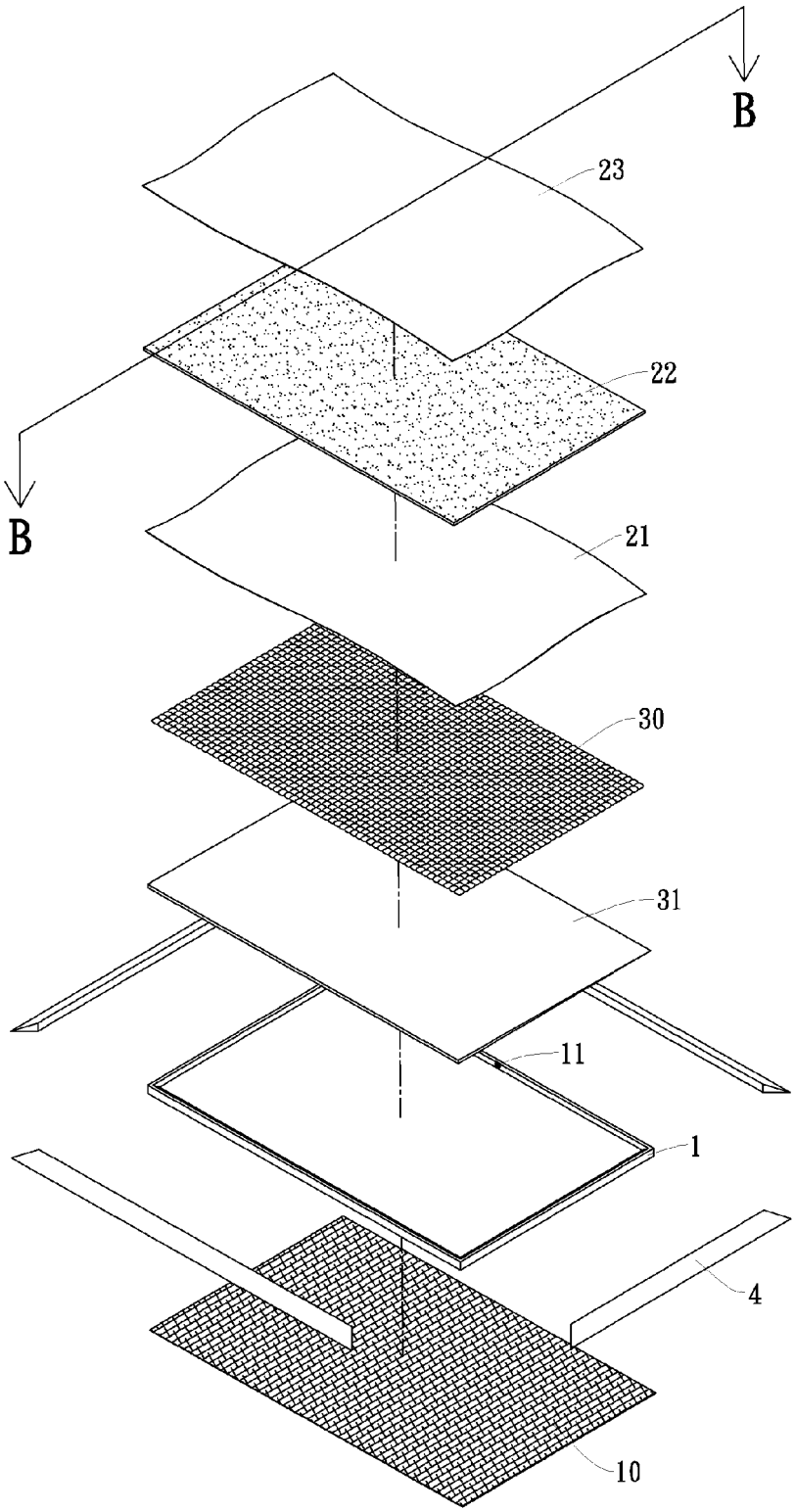
FIG. 4 is an exploded view of a second preferred embodiment of water absorbing mat according to the invention.
Figure 5:
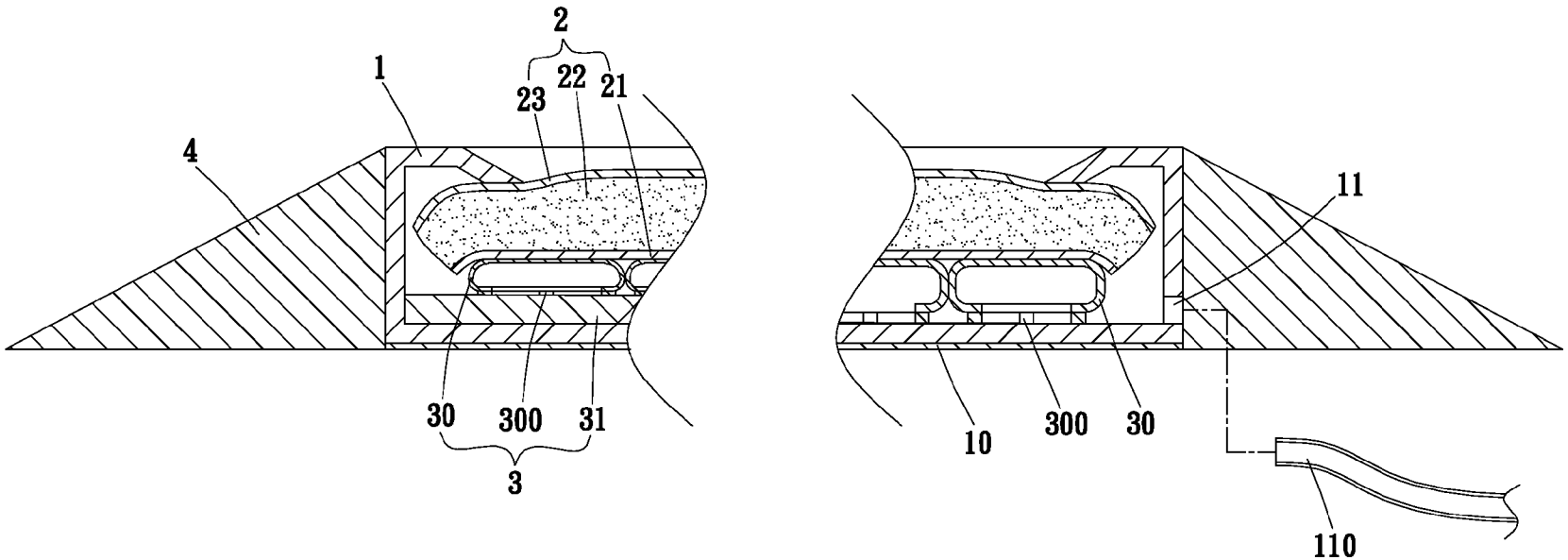
FIG. 5 is a sectional view taken along line B-B of FIG. 4 with the water absorbing mat assembled.
Figure 7:
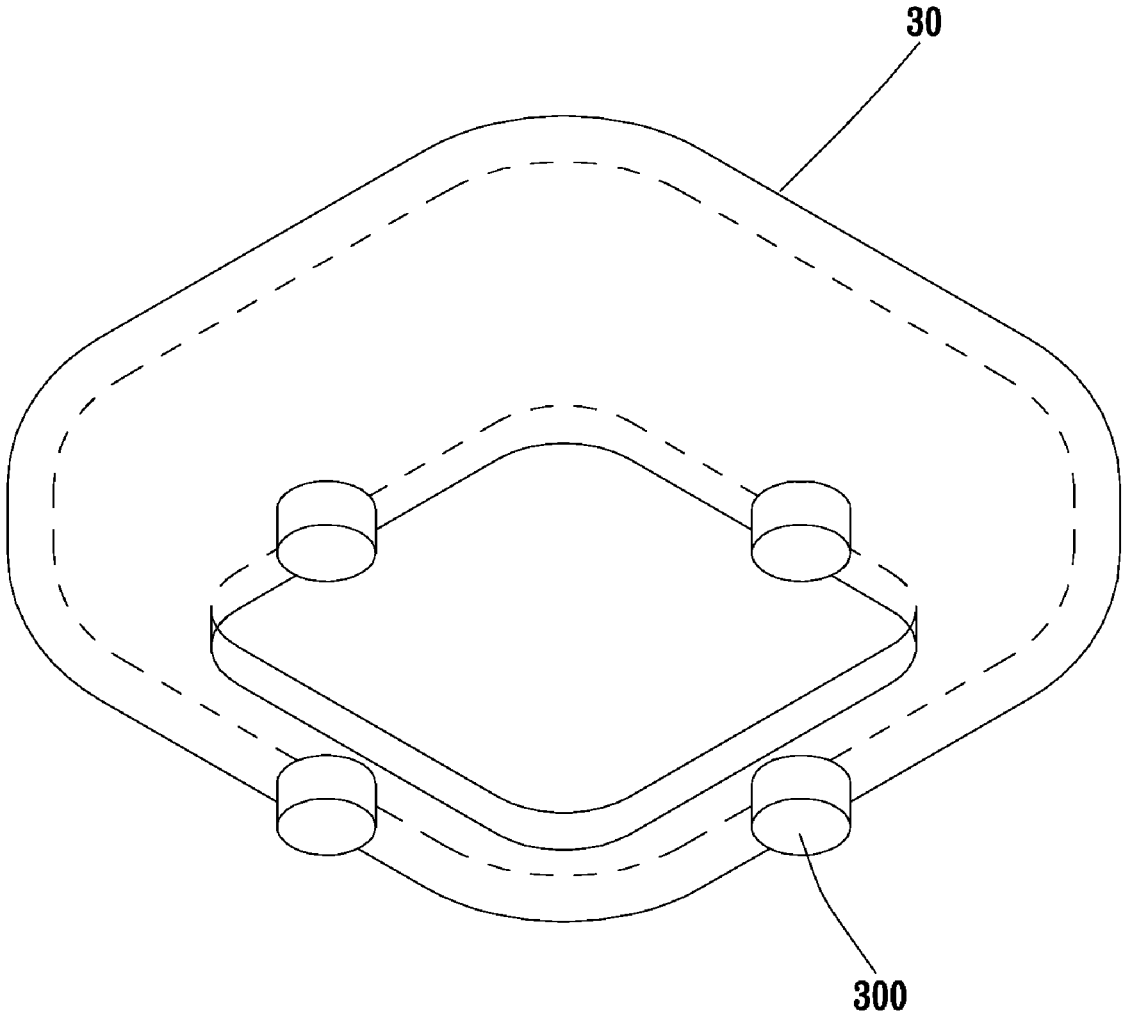
FIG. 7 is a perspective view of the water bladder and its legs shown in either preferred embodiment.

Referring to FIGS. 4 to 5 and 7, a water absorbing mat in accordance with a second preferred embodiment of the invention is shown. The characteristics of the second preferred embodiment are detailed below. The water absorbing material 20 of the first preferred embodiment is replaced with an intermediate water absorbing foam 22 and a protective water absorbing fabric 23 put on the water absorbing foam 22. The second preferred embodiment can further increase water absorbing capability.

Figure 6:
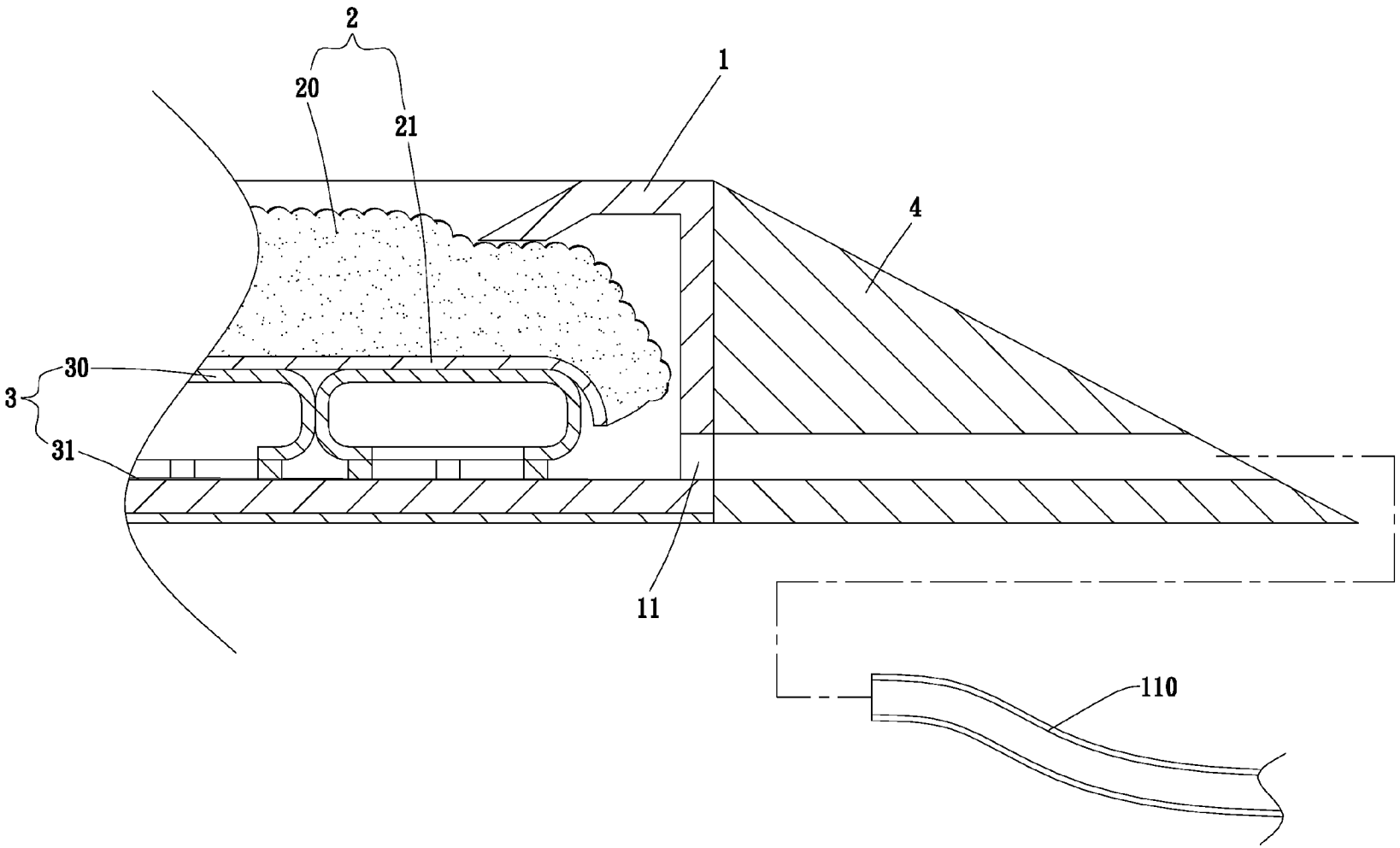
FIG. 6 is a view similar to the right portion of FIG. 5 but t he edge member is integrally formed with the base and a passage communicating the external and the valve is provided in the edge member.

Referring to FIG. 6, the edge members 4 are integrally formed with the base 1 and a passage (not numbered) is formed therein for communicating the external and the valve 11. In use, the pipe 110 can be connected to the passage for discharging water. This has the advantage of without removing the edge member 4 prior to water discharge.

While the invention herein disclosed has been described by means of specific embodiments, numerous modifications and variations could be made thereto by those skilled in the art without departing from the scope and spirit of the invention set forth in the claims.

What is claimed is:

1. A water absorbing mat comprising:

a base having an internal space open to a top;

a squeezing unit disposed in the internal space and comprising a plurality of water bladders having a plurality of legs; and a water absorbing unit disposed on the water bladders and formed of a predetermined water absorbing material.

2. The water absorbing mat of claim 1, wherein an edge of the base is inclined inward.

3. The water absorbing mat of claim 2, further comprising edge means having an inclined outer surface secured to the edge of the base.

4. The water absorbing mat of claim 3, wherein the edge means is integrally formed with the edge of the base, the edge means comprising a passage having one end terminating at the edge of the base and the other end being open.

5. The water absorbing mat of claim 1, wherein the base comprises a slip resistant layer on an underside.

6. The water absorbing mat of claim 1, wherein the water absorbing unit comprises a water permeable fabric rested upon the water bladders.

7. The water absorbing mat of claim 1, wherein the base comprises a valve at one side.

8. The water absorbing mat of claim 7, wherein the squeezing unit further comprises a spacer layer disposed between the water bladders and a bottom of the internal space of the base, the spacer layer being inclined toward the valve.

9. The water absorbing mat of claim 8, wherein the water bladders are shaped to conform to the spacer layer.

10. The water absorbing mat of claim 1, wherein the predetermined water absorbing material is pile threads.

11. The water absorbing mat of claim 1, wherein the predetermined water absorbing material is foam.

* * * * *